US006209267B1

(12) United States Patent
Dantzer

(10) Patent No.: US 6,209,267 B1
(45) Date of Patent: Apr. 3, 2001

(54) DECKING SYSTEM

(76) Inventor: Hugh A. Dantzer, 10531 - 140 Street, Edmonton, Alberta (CA), T5N 2M1

( * ) Notice: Subject to any disclaimer, the term of this patent is extended or adjusted under 35 U.S.C. 154(b) by 0 days.

(21) Appl. No.: 09/196,175

(22) Filed: Nov. 20, 1998

(51) Int. Cl.[7] ..... E04B 5/02
(52) U.S. Cl. ..... 52/79.6; 52/480; 52/650.3
(58) Field of Search ..... 52/79.6, 79.5, 52/263, 480, 477, 384, 650.3, 403.1, 586.1

(56) References Cited

U.S. PATENT DOCUMENTS 3,504,472 * 4/1970 Clement ..... 52/477
4,028,858 * 6/1977 Rehbein ..... 52/384
4,468,901 * 9/1984 Henderson et al. ..... 52/79.6
4,628,645 * 12/1986 Tafelski, Jr. ..... 52/477 X
4,691,484 * 9/1987 Wilson ..... 52/79.6
4,918,880 * 4/1990 Carney ..... 52/79.6 X
5,230,186 * 7/1993 Hammonds et al. ..... 52/79.6
5,361,554 * 11/1994 Bryan ..... 52/480
5,617,697 * 4/1997 Erwin ..... 52/79.6 X
5,623,803 * 4/1997 Willis ..... 52/79.6
5,850,720 * 12/1998 Willis ..... 52/650.3

FOREIGN PATENT DOCUMENTS

WO 95/03456 * 2/1995 (WO) ..... 52/650.3

* cited by examiner

*Primary Examiner*—Richard Chilcot
(74) *Attorney, Agent, or Firm*—George A. Seaby

(57) ABSTRACT

A modular decking system for use in constructing a deck of the type normally attached to a house or cottage includes a plurality of square, typically one meter by one meter, frames which are mounted on posts; deck or floor panels which are mounted on the frames; finishing planks for mounting on the outside edges of the frames to finish the base of the deck; and a railing assembly including posts for mounting on the corners of the base and at the junction between finishing planks, and rectangular fence panels which are connected to the posts, mainly by sliding the panels into longitudinally extending grooves in the posts.

9 Claims, 8 Drawing Sheets

DECKING SYSTEM

BACKGROUND OF THE INVENTION

1. Field of the Invention

This invention relates to a decking system, and in particular to a modular, wooden decking system of the type usually attached to a house or other dwelling.

2. Discussion of the Prior Art

Conventional decks are usually produced on site using lumber in a variety of lengths. The conventional deck includes a frame supported by square cross section (usually 4"×4" treated lumber), a floor attached to the frame, and a railing defined by the posts extending upwardly beyond the floor, rails extending between the posts and a latticework or balustrade between the posts. In general, the only elements of the deck which are prefabricated or cut to their final length are the latticework or the balusters used in the construction of the balustrade. As a result, often there is a large amount of waste when constructing a deck, and accordingly it is necessary to ship unduly large quantities of wood to locations where wood is scarce, e.g. Japan.

GENERAL DESCRIPTION OF THE INVENTION

An object of the present invention is to provide a solution to the above-identified problem in the form of a relatively simple modular decking system, in which most of the elements of the system are precut and possibly preassembled. By mass producing decks, there is relatively little waste.

Another object of the invention is to provide a modular decking system which is elegantly simple in design and easy to assemble, even in the absence of any carpentry experience.

Accordingly, the present invention relates to a modular decking system comprising:

- a polygonal frame for connection in contiguous relationship to similar frames to define a base;
- a floor panel for mounting said frame for covering said frame to define a floor of the decking system with similar, contiguous floor panels; and
- a finishing plate for attachment to an outer side of said frame for defining an outer side wall of the base, in the assembled condition, said finishing plate extending upwardly beyond the top of said frame to the same level as the top surface of said floor panel, whereby the tops of side plates and floor panels define a planar top surface of the deck.

DESCRIPTION OF THE PREFERRED EMBODIMENT

Figure 1:
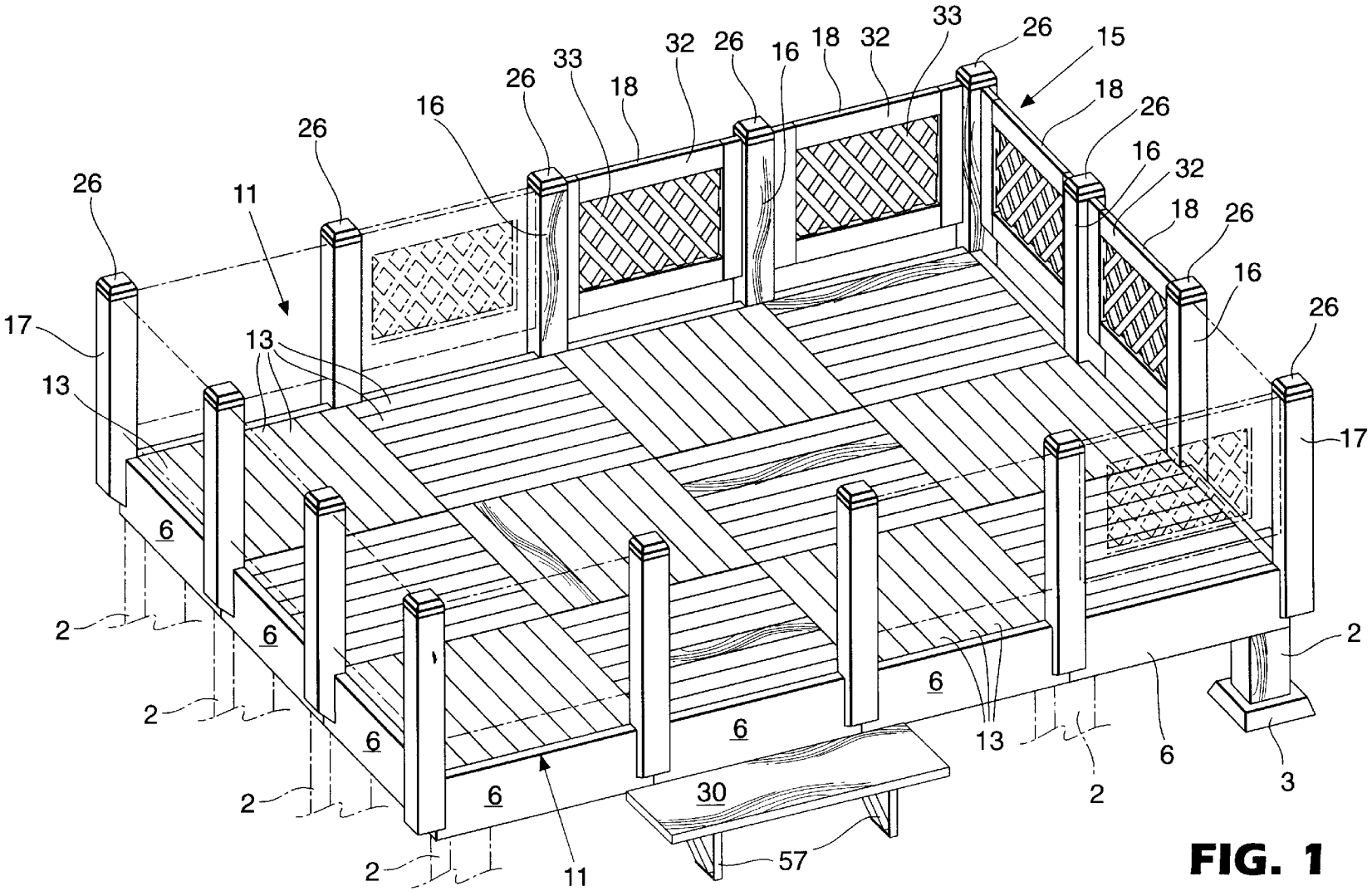
FIG. 1 is a schematic isometric view of a decking system in accordance with the present invention.
Figure 2:
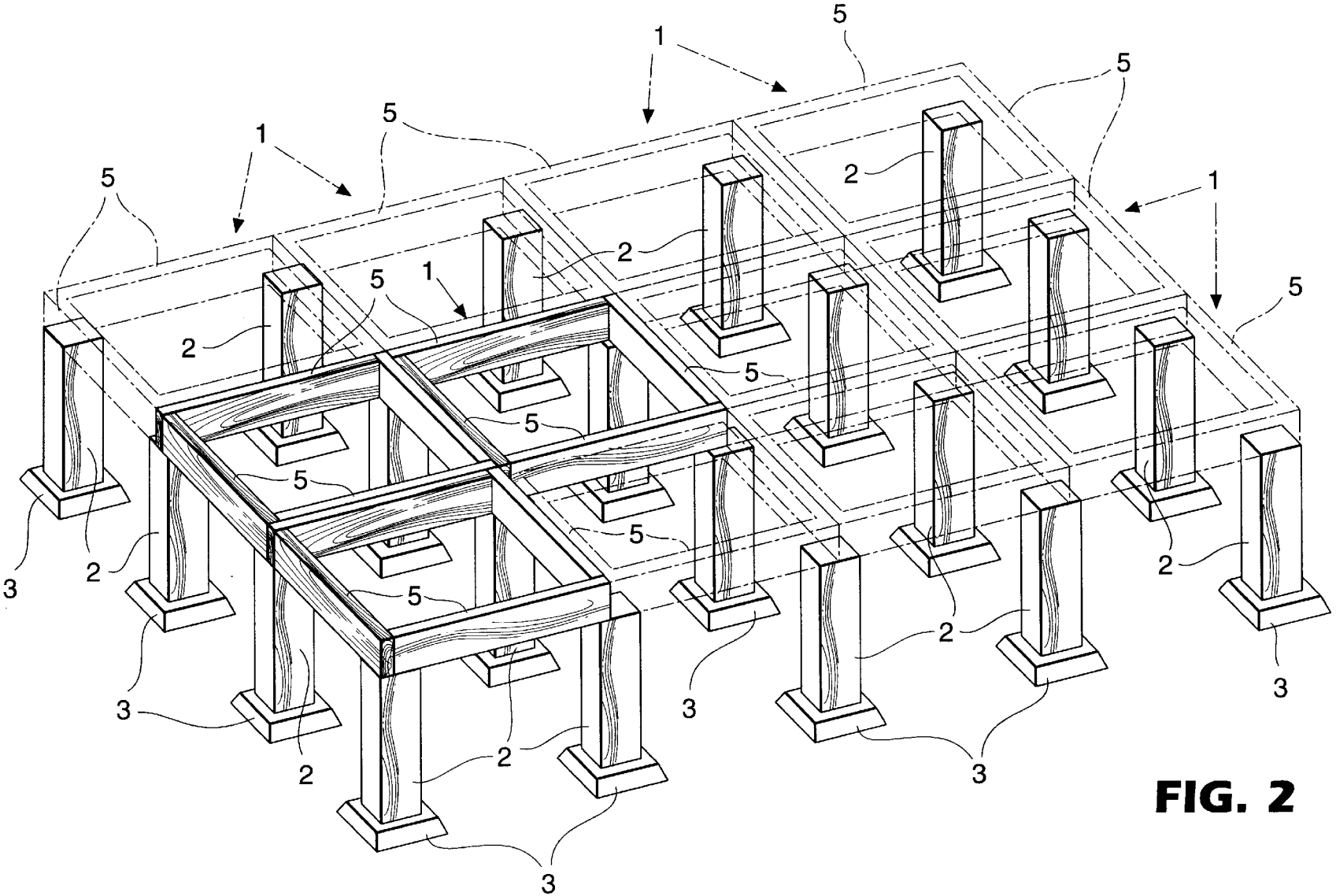
FIG. 2 is an isometric view of the base of the decking system of FIG. 1.
Figure 3:
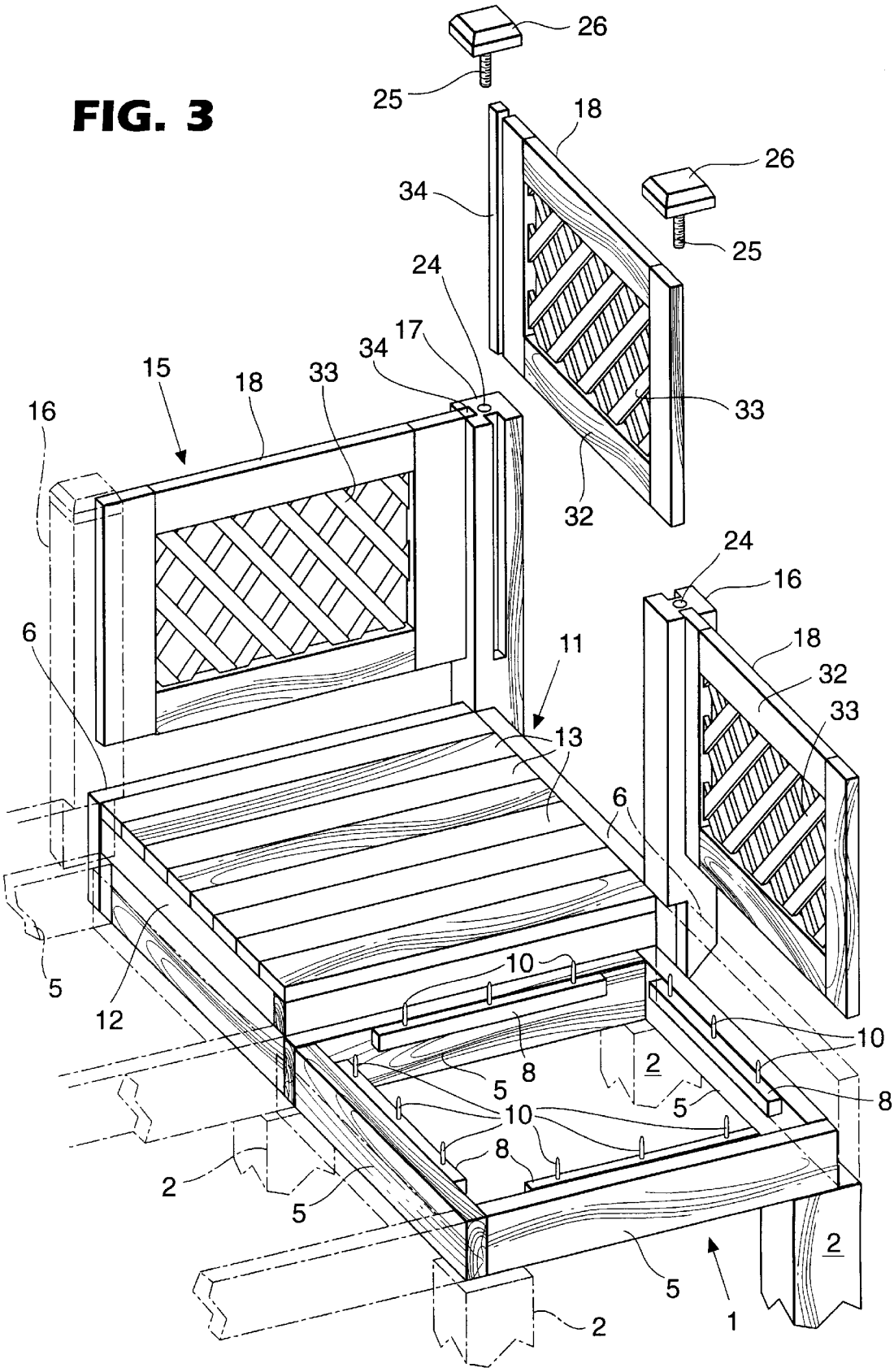
FIG. 3 is a partly exploded, isometric view of one corner of the decking system of FIG. 1.

Referring to FIGS. 1 to 3, one of the basic elements of the railing system of the present invention is a rectangular base frame generally indicated at 1. A plurality of frames 1 are interconnected to form a rectangular or square base, the number of frames 1 depending upon the desired size of the deck. Typically, the dimensions of each frame 1 are one meter by one meter. The frames 1 are mounted on conventional square cross section posts 2, which are supported on off-the-shelf concrete foundation blocks 3. Alternatively, the posts 2 are mounted in a commercially available bracket and spike combination which is driven into the ground or in a bracket and anchor combination which is set in concrete. When the deck extends outwardly from a wall of a house or other building, the frames 1 can be attached directly to the building wall in the usual manner.

As best shown in FIGS. 2 and 3, each frame 1 is defined by four interconnected sides 5 defining a square. Once the desired number of frames 1 have been assembled, a side plate or finishing board 6 is attached to the outer side of each outer frame 1 by screws (not shown) extending from the inside of the frame outwardly through the frame 1 and into the finishing board 6. Since the board 6 defines the outside of the base of the deck, the board is formed of an attractive, smoothly finished wood such as Western red cedar, i.e. dressed lumber.

When the system is sold in kit form, the frames 1 are preassembled, as are floor panels 7, which are mounted on the frames 1 after the frames have been assembled on the posts 2. For such purpose anchors 8 (FIG. 2) are attached to the interior of the sides 5 of the frames 1 by nails or screws (not shown) during assembly. The anchors 8 are merely strips of wood with nails 10 extending therethrough. The anchors 8 are nailed or screwed to the sides 5 of the frames 1 with the exposed pointed ends of the nails 10 extending upwardly.

The floor of the deck is defined by floor panels generally indicated at 11. As best shown in FIG. 3, each floor panel 11 includes a rectangular frame 12 and a plurality of planks 13 mounted thereon. The panel 11 is placed on the base frame 1, and downward pressure is applied to cause the nails 10 to penetrate the frame 12. In the embodiment of the invention illustrated in FIG. 3, the sides of the frame 12 have a double thickness, the nails 10 penetrating the inner thickness of wood. Another alternative is to use a square frame, which is recessed with respect to the planks 13. As shown in FIG. 1, when assembling the floor, the floor panels 11 are preferably alternated, i.e. the planks 13 of one panel 11 are at right angles to the planks 13 of each adjacent panel 11.

Figure 4:
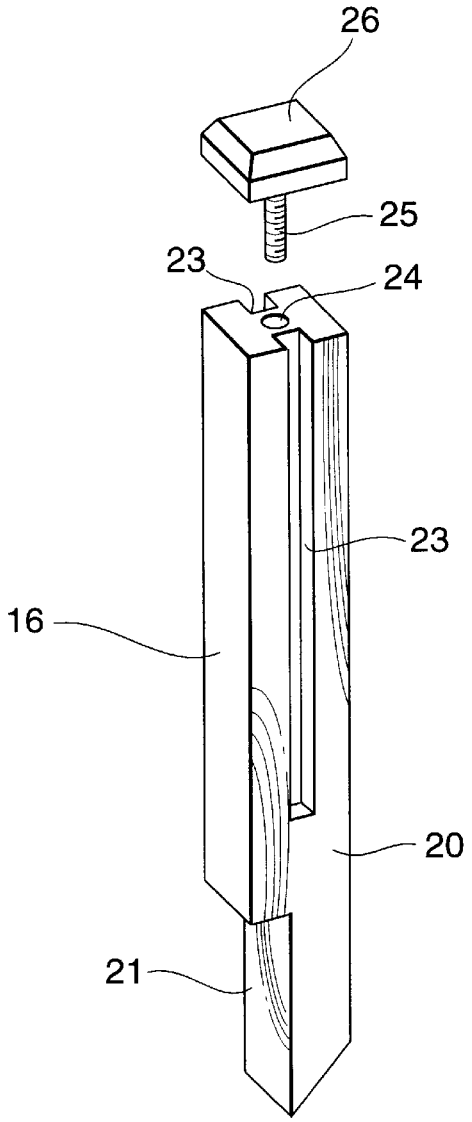
FIG. 4 is an exploded isometric view of an intermediate post used in the decking system of FIG. 1.
Figure 5:
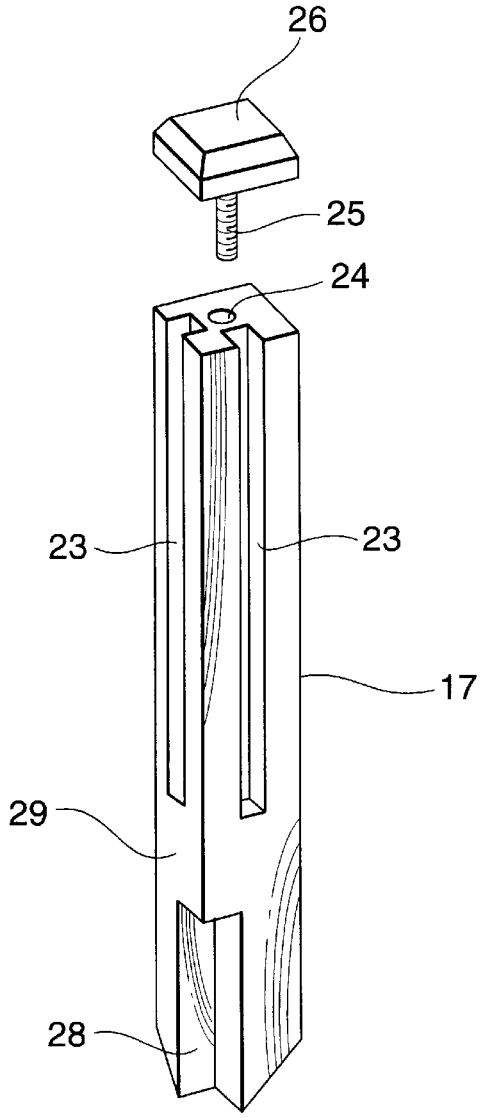
FIG. 5 is an exploded isometric view of a corner post used in the decking system of FIG. 1.

With the floor in place, a railing generally indicated at 15 is added to the deck. The railing 15 is defined by a plurality of posts 16 and 17, and railing panels 18. An intermediate post 16 is provided at the outer junction of each pair of floor panels 11, i.e. at the junction between each pair of boards 6, and a corner post 17 is provided at each outside corner of the deck. Referring to FIG. 4, each intermediate post 16 includes an elongated wooden body 20 with a right angle notch 21 in the bottom end thereof for mounting the post 16 on the edge of the deck floor. Longitudinally extending grooves 23 are provided in each side of the post body 20 for slidably receiving the ends of railing panels 18. The grooves 23 stop short of the bottom of the post 16. A bore 24 in the top end of the post body 20 receives a bolt 25 extending downwardly from a cap 26.

The corner posts 17 are similar to the intermediate posts 16, except that a notch 28 is provided in the bottom inner corner of the post body 29 for mounting the posts 17 on the corners of the deck base. Moreover, the grooves 23 are in adjacent sides of the post body 29 so that the panels 18 at the corners of the deck define right angles. The posts 16 and 17 are bolted, screwed or nailed to the base of the deck.

When all of the posts 16 and 17 have been mounted on the base of the deck, the fence panels 18 are slid into the grooves 23 to complete the railing. As shown in FIG. 1, a gap is left between two posts 16 or 16 and 17 permitting access to the deck via a step 30 or steps. Each panel 18 is defined by a rectangular wooden frame 32 and a latticework 33 mounted in the frame 32. Because the spacing between the corner posts 17 and an adjacent intermediate post 16 is greater than the distance between adjacent intermediate posts 16, an extension or filler strip 34 (FIG. 3) is provided for mounting on the corner post ends of the railing panels 18. The strip 34 is attached to the end of the panel 18 and fills the groove 23 when the panel 18 is mounted in the posts 16 and 17.

Figure 6:
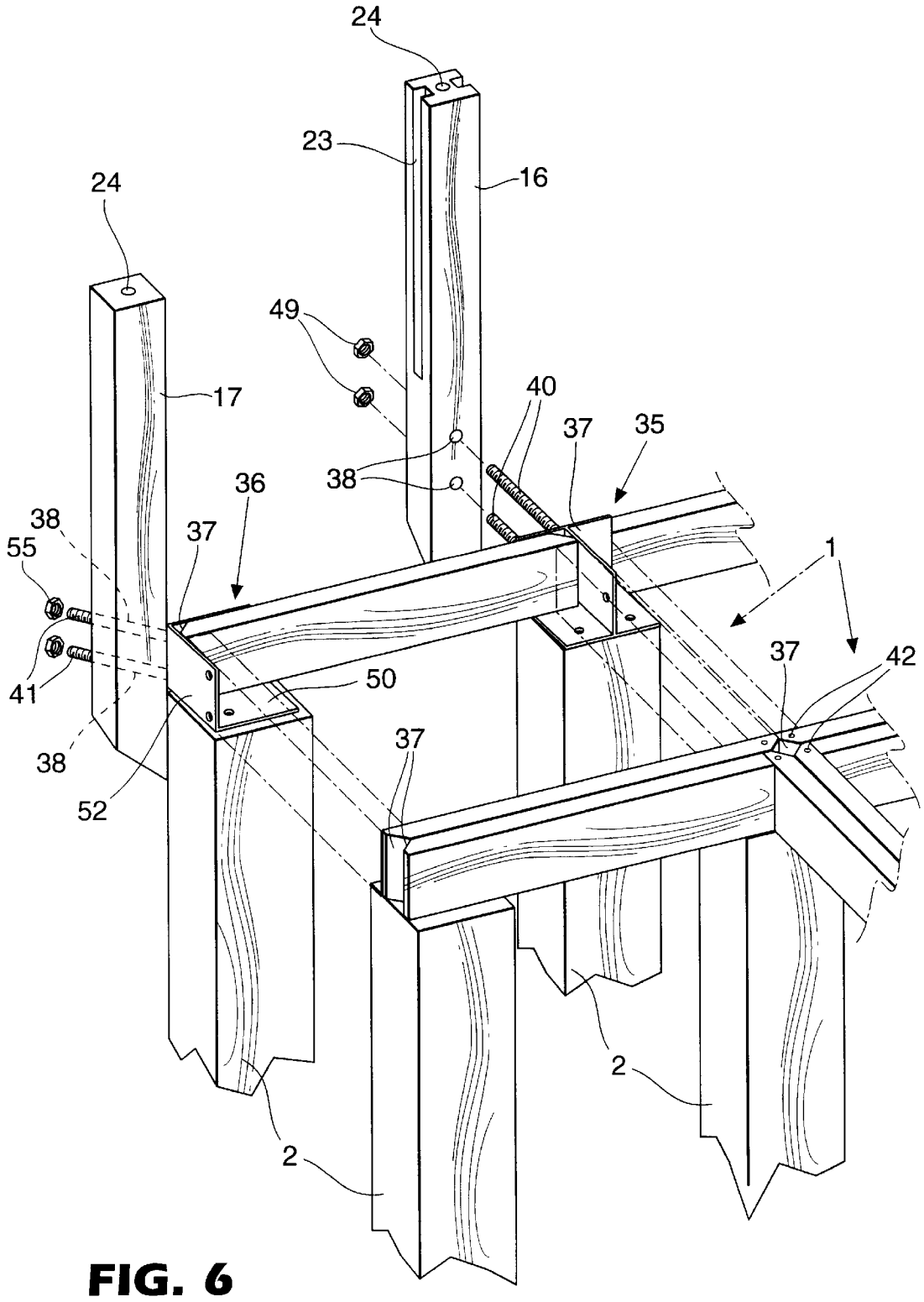
FIG. 6 is a partly exploded, isometric view of one corner of the base of a second embodiment of the decking system of the present invention.
Figure 7:
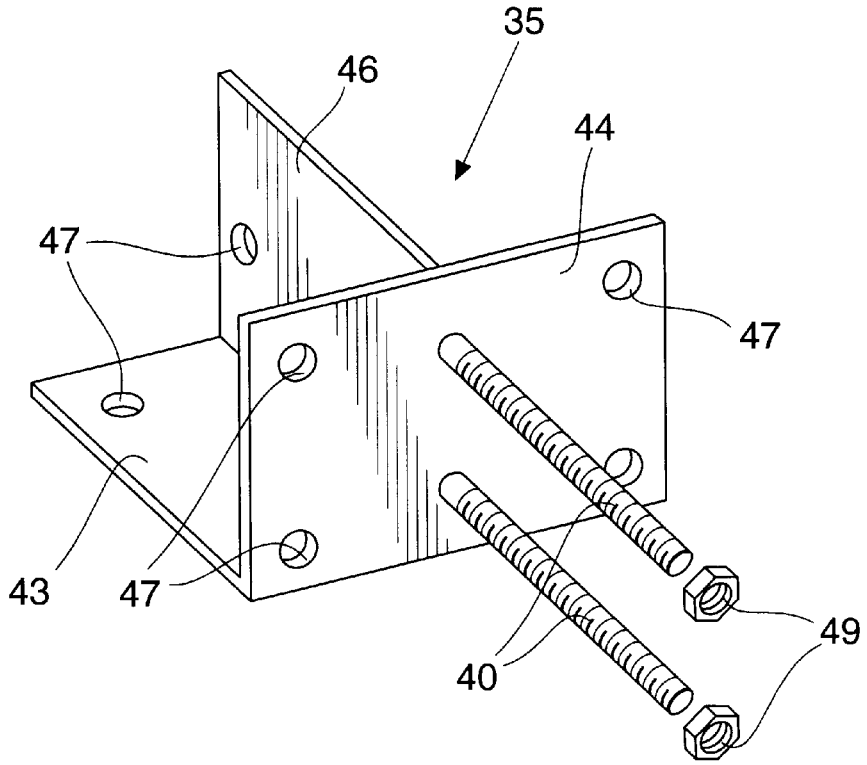
FIG. 7 is an isometric view of a tee-bracket used in the decking system of FIG. 6.
Figure 8:
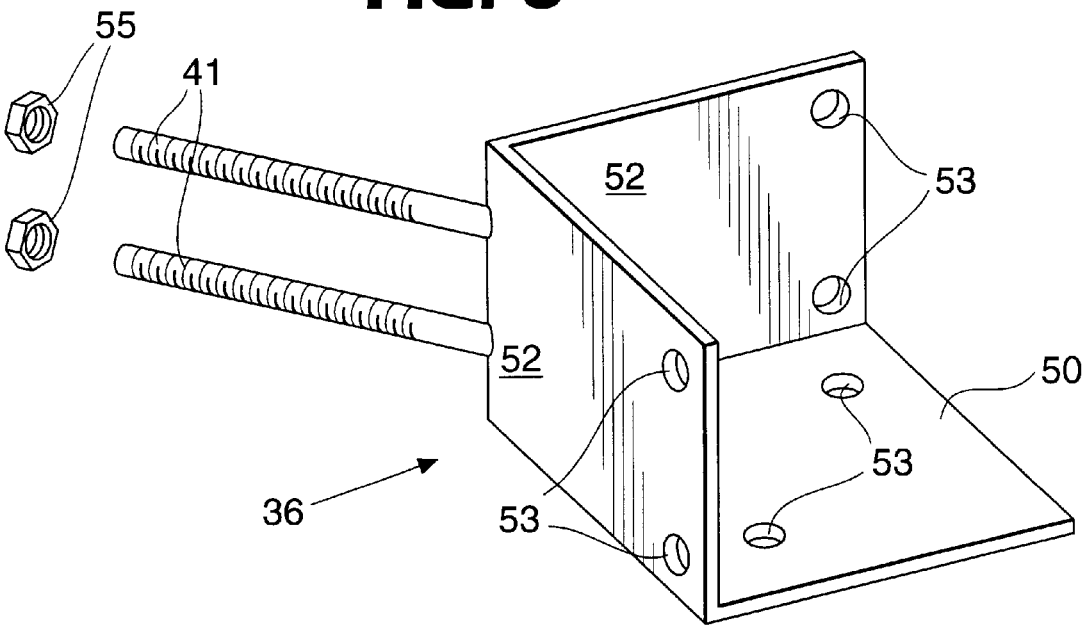
FIG. 8 is an isometric view of a corner bracket used in the decking system of FIG. 6.

Referring to FIGS. 6 to 8, the deck can also be formed using intermediate and corner brackets generally indicated at 35 and 36. When the brackets 35 and 36 are used, the corners 37 of the frames 1 are bevelled to improve the fit in the brackets 35 and 36. Because the brackets 35 and 36 are formed of metal plates joined by welding, there may be weld bulges at the corners of the brackets. If the corners 37 of the frames 1 are not bevelled, the bulges may make it difficult to mount the frames 1 fully in the brackets 35 and 36. Moreover, when the brackets 35 and 36 are employed, the notches 21 and 28 in the bottom ends of the posts 16 and 17, respectively are omitted. Instead, holes 38 are provided in the posts 16 and 17 for receiving bolts 40 and 41 extending outwardly form the brackets 35 and 36, respectively. Pre-drilled holes 42 (four shown) are provided in the corners of the frames 1 for receiving nails for securing the frames to all of the posts 2 except those on the outside of the base.

With reference to FIG. 7, each intermediate bracket 35 includes a generally L-shaped body defined by a bottom plate 43 and an end plate 44. A partition 46 is connected to the bottom and end plates 43 and 44, respectively. The plates 43 and 44, and the partition 46 contain holes 47 for receiving nails or screws. The bottom bracket 35 is mounted on the top end of a post 2. The corners 37 of a pair of adjacent frames 1 are placed on the bottom plate 43 on opposite sides of the partition 46. When the floor of the deck has been completed, an intermediate post 16 is mounted on the bolts 40 and nuts 49 are tightened on the bolts 40 to secure the post 16 in position.

In the same manner, the square bottom plates 50 of the corner brackets 36 (FIG. 8) are mounted on the corner posts 2, and the outer corners of the frames 1 are placed between the sides 52 of the brackets 36. Thus, the frames 1 are securely connected to the posts 2. Holes 53 are provided in the bottom plates 50 and sides 52 of the brackets 36 for receiving screws or nails. The holes 39 in the bottom of the corner posts 17 extend diagonally through the posts. When the posts 17 are mounted on the bolts 41, nuts 55 are placed on the bolts 41 to secure the corner posts 17 in position. By omitting the longitudinally extending grooves in the corner posts 17, the need for extension strips 34 on the ends of the railing panel 18 is obviated.

Figure 9:
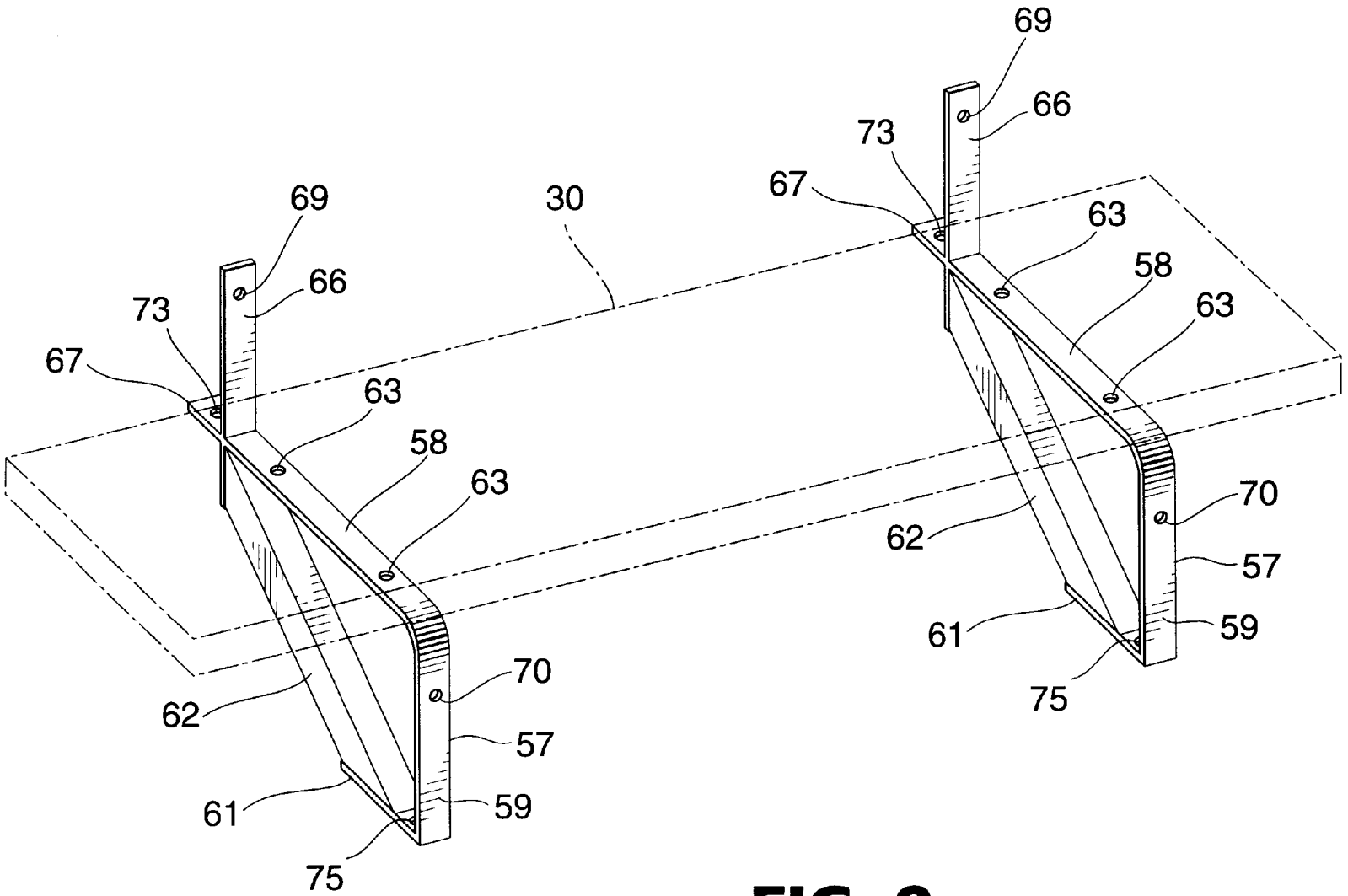
FIG. 9 is an isometric view of a step and brackets used in the decking system of FIGS. 1 to 8.
Figure 10:
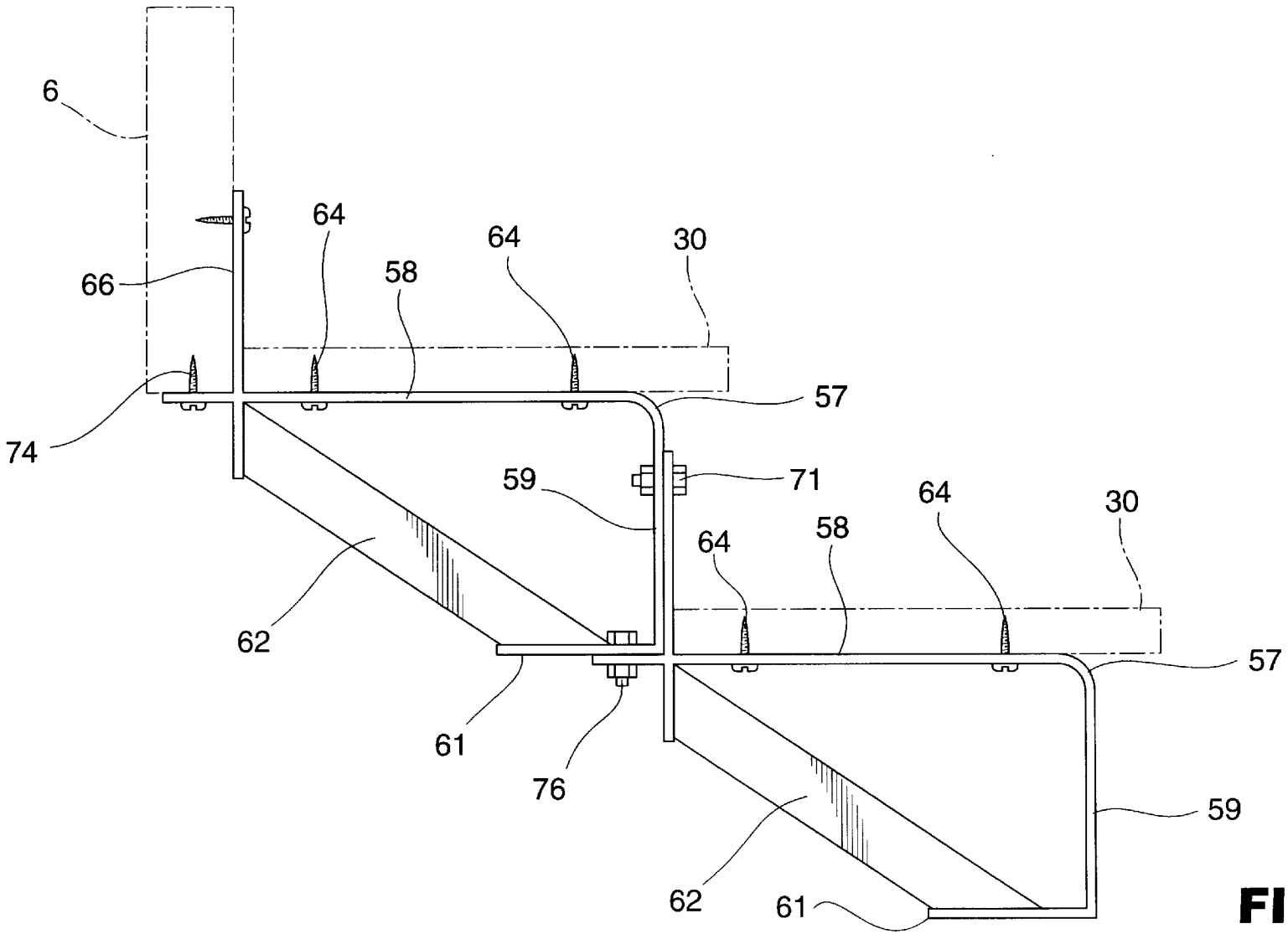
FIG. 10 is an end view of a pair of steps and the brackets of FIG. 9.

Referring to FIGS. 9 and 10, the decking system is completed by brackets 57 facilitating the mounting of a step or steps 30 on one side of the deck. Each bracket 57, which is generally triangular includes a horizontal top 58 for supporting a step (or tread) 30, a vertical front 59 integral with the top 58, a horizontal bottom 61, and an inclined, tubular steel brace 62 extending between the rear ends of the top 58 and the bottom 61. Holes 63 in the top 58 receive screws 64 (FIG. 10) for securing a step 30 on the bracket 57. Arms 66 and 67 extend upwardly and rearwardly, respectively from the top 58 for connecting the bracket 57 to a finishing board 6 or to another similar bracket 57 (FIG. 10). A hole 69 near the top of the vertical arm 66 receives a nail, screw or bolt when the arm 64 is connected to a finishing board 6. When the bracket 57 is connected to a second bracket 57 for supporting two steps, the hole 69 in the arm 66 of the lowermost bracket is aligned with a hole 70 in the front 59 of the uppermost bracket 57 for receiving a bolt 71 (FIG. 10). Similarly, a hole 73 is provided in the horizontal arm 67 of the bracket 57 for receiving a screw 74 (FIG. 10) which connects the arm 67 to the bottom of the finishing board 6. When the bracket 57 is connected to another similar bracket 57, the hole 73 in the lower bracket is aligned with a hole 75 in the horizontal bottom 61 of the upper bracket for receiving a bolt 76.

In its simplest form, the decking system includes a plurality of frames 1, the finishing boards or side plates 6 and the floor panels 11. The intent of the inventor is to provide a kit involving a complete decking system for assembly on site. The kit is relatively compact because virtually all of the elements are precut. In fact, the only elements which require any adjustment on site are the posts 2 for supporting the base. Thus, if one meter by one meter frames 1 are used, the longest element will have a length of approximately one meter, unless a higher railing is desired.

I claim:

1. A modular decking system comprising:

a plurality of polygonal first frames for connection to each other in contiguous relationship to define a base;

a plurality of floor panels for mounting on said base in contiguous relationship to each other, the floor panels covering the base to define a floor of the decking system, each floor panel including a second frame and a plurality of planks thereon for defining said floor of the system;

a finishing plate for attachment to an outer side of said base for defining an outer side wall of the base, in the assembled condition said finishing plate extending upwardly beyond the top of said base to the same level as the top surface of said floor panel, whereby the tops of side plates and floor panels define a planar top surface of the deck.

2. The decking system of claim 1 including:

a railing for attachment to said base, said railing including posts for connection to the base at each corner of the base and at each outer junction between contiguous first frames; and fence panels for extending between said posts in the assembled condition of the system.

3. The decking system of claim 2, including a tee bracket for interconnecting the outer corners of contiguous first frames; and bolts extending outwardly from said tee bracket for connecting a post to the base of the system.

4. The decking system of claim 3, including a corner bracket for supporting an outer corner of the base; and bolts extending outwardly form said corner bracket for connecting a corner post to the base of the system.

5. The decking system of claim 4, wherein said first frame includes bevelled corners facilitating mount of the first frames in a tee or corner bracket.

6. The decking system of claim 1 including floor panel anchors on said first frames for securing said floor panels to said first frames.

7. The decking system of claim 6, wherein said anchors include strips containing upwardly extending nails for attachment to side edges of said first frames for penetrating said floor panels when the latter are pressed down onto said first frames.

8. The decking system of claim 7, wherein each floor panel has the same length and width as each said first frame, whereby each first frame is completely covered by one said floor panel when mounted thereon.

9. The decking system of claim 1, including a step for mounting on one side of said base, said step including a generally triangular step bracket, the stop bracket being defined by a top for supporting a tread; a first horizontal arm extending rearwardly from the top for connecting the step bracket to the bottom of a finishing plate or to the bottom of another similar step bracket; and a second vertical arm extending upwardly from the top adjacent said first arm for connecting the step bracket to the front of the finishing plate or to the front of another similar bracket, whereby the step bracket can be used to form one or more steps on the decking system.

* * * * *